United States Patent [19]

Fink, Jr. et al.

[11] Patent Number: 4,675,794

[45] Date of Patent: Jun. 23, 1987

[54] ADJUSTABLE MOUNT FOR A HIGH INTENSITY LAMP

[75] Inventors: Thomas F. Fink, Jr., Macedonia; William O. Harris, Lakewood; Gilbert H. Reiling, Chardon, all of Ohio

[73] Assignee: General Electric Company, Schenectady, N.Y.

[21] Appl. No.: 880,415

[22] Filed: Jun. 30, 1986

[51] Int. Cl.[4] ..... F21V 9/00

[52] U.S. Cl. ..... 362/289; 362/285

[58] Field of Search ..... 362/289, 270, 277, 278, 362/285, 286, 287; 350/611

[56] References Cited

U.S. PATENT DOCUMENTS

| | | | |
|---|---|---|---|
| 1,220,395 | 3/1917 | Buchanan | 362/289 |
| 1,610,127 | 12/1926 | Godley | 362/289 |
| 2,186,439 | 1/1940 | Whalen | 362/289 |
| 2,212,975 | 8/1940 | Boynton | 362/289 |
| 2,217,790 | 10/1940 | Boynton | 362/289 X |
| 4,410,933 | 10/1983 | Blaket et al. | 362/371 |
| 4,429,471 | 12/1983 | Gordin et al. | 362/66 X |
| 4,602,321 | 7/1986 | Bornhorst | 362/285 X |

FOREIGN PATENT DOCUMENTS

| | | | |
|---|---|---|---|
| 335539 | 4/1921 | Fed. Rep. of Germany | 362/289 |

*Primary Examiner*—Larry Jones

*Attorney, Agent, or Firm*—Nathan D. Herkamp; John P. McMahon; Philip L. Schlamp

[57] ABSTRACT

A fixture for a high intensity discharge lamp includes a support mechanism allowing the adjustable positioning of the lamp relative to the reflector within the fixture in order to control the beam spread of the light output of the lamp and fixture combination so that focusing of the illumination can be controlled.

8 Claims, 5 Drawing Figures

ADJUSTABLE MOUNT FOR A HIGH INTENSITY LAMP

BACKGROUND OF THE INVENTION

1. Field Of The Invention

The present invention relates to fixtures for mounting high intensity lamps and, more particularly, to an adjustable fixture allowing control of beam spread for the light output of a high intensity discharge lamp.

2. Description Of The Prior Art

Spotlights and flood lights are often utilized to light the exterior of buildings and monuments to highlight certain features and create an aestheticly appealing image to an observer. In some uses a broad light beam is desired to illuminate a large surface area, while in other uses a narrow light beam to highlight a particular area or feature of an object to be illuminated is more desirable. In the prior art one specific fixture with a predetermined light focusing pattern is typically used for lighting a broad area and a separate fixture with a different focusing pattern is used for lighting a smaller area for accent and emphasis especially with respect to monuments and sculptural objects. Typical of prior art fixtures is one shown in U.S. Pat. No. 4,410,933, issued Oct. 18, 1983 to Blake et al and assigned to the present assignee. The Blake et al patent shows a luminaire having an indicator and positive stop to allow adjustment and setting of the angle of aim of the fixture relative to the object being illuminated but allowing only one focusing pattern. Thus, the prior art requires use of multiple fixtures where multiple focusing patterns are required.

SUMMARY OF THE INVENTION

An object of the present invention is to provide a variable focus fixture for an electric light source which allows varying the focus of light output over a range of focusing patterns from a broad, diffuse area lighting pattern to a narrowly focused lighting pattern from the same fixture. A more specific object of the present invention is to provide a mounting mechanism within a high intensity lamp fixture which allows movement of the light source within the fixture relative to a reflector surrounding the light source to allow adjustment of the light focusing pattern.

Accordingly, the present invention includes a housing surrounding the light source, generally parabolic reflector and an adjustable lamp socket support mechanism for positioning the lamp socket relative to the parabolic reflector; the adjustment mechanism comprising in a preferred embodiment a manually operable screw mechanism for adjusting the position of a support bracket and lamp socket to a desired position relative to the reflector, such that the position of a lamp connected to the lamp socket relative to the reflector may be controlled to control the beam spread of the light output of the light source.

BRIEF DESCRIPTION OF THE DRAWINGS

Further objects and advantages of the present invention, together with its organization, method of operation and best mode contemplated may best be understood by reference to the following description taken in conjunction with the accompanying drawings in which:

FIG. 1*a* is a schematic elevation view illustrating the adjustable lamp support the present invention;

FIG. 1*b* is a detailed enlargement of a portion of the mechanism shown in FIG. 1*a;*

FIG. 2 is an end view of the mechanism illustrated in FIG. 1*a;*

FIG. 3 is a schematic side elevation view along line 3—3 of the mechanism illustrated in FIG. 1*a.

DESCRIPTION OF THE PREFERRED EMBODIMENTS

Figures 1A, 1B, 2, 3:
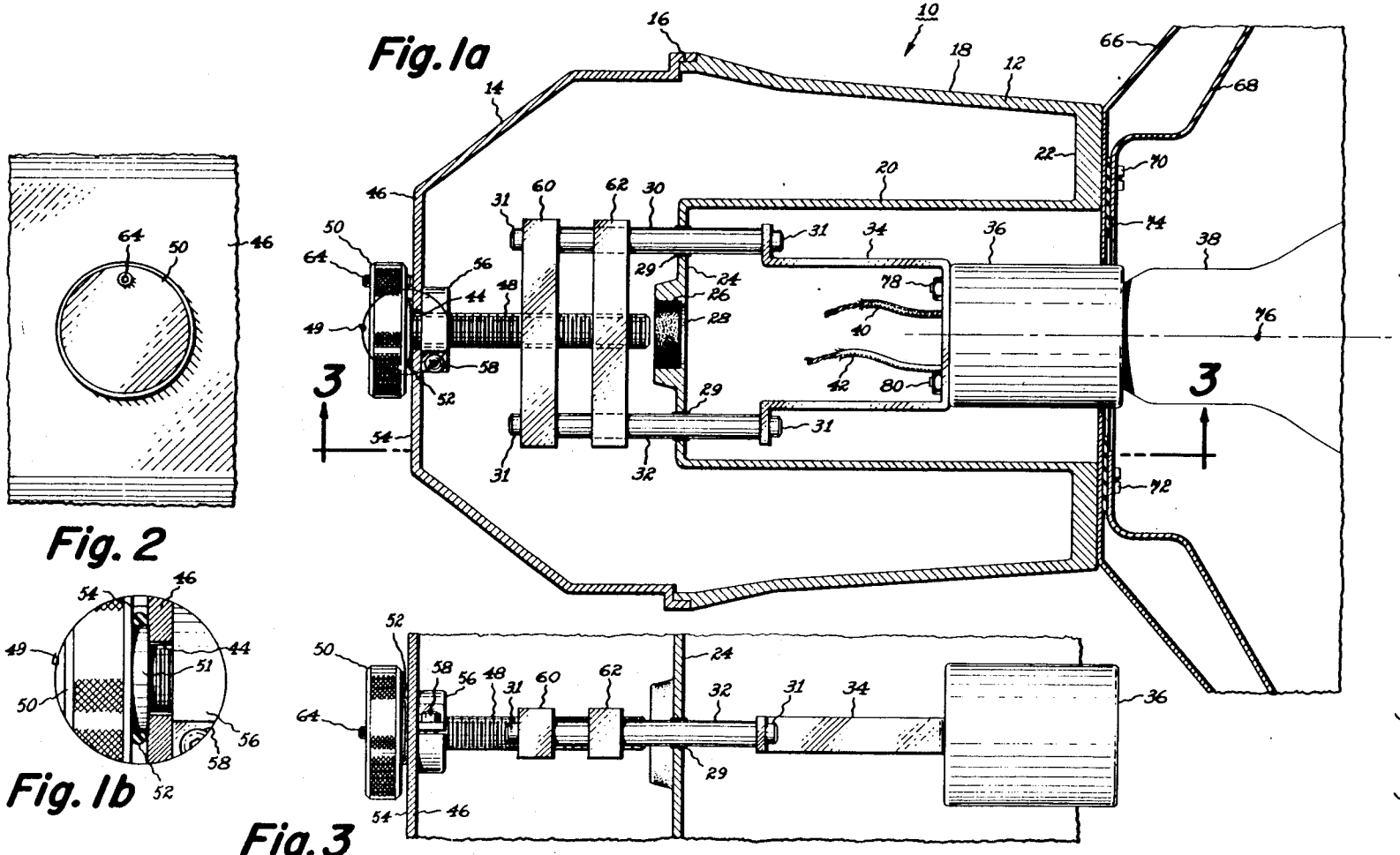

FIGS. 1*a,* 1*b,* 2 and 3 illustrate schematically a preferred embodiment of the present invention. The fixture 10 includes a housing member 12 with a housing end cap 14 connected thereto at the joint 16 for example by screws (not shown). The housing member 12 which typically includes some mechanism (not shown) for connecting the fixture to a support post comprises a pair of generally concentric rings 18, 20 joined by a ring shaped member 22 into a generally annular housing member. The housing end cap 14 is joined to the outer wall 18 to complete the housing enclosing the position adjustment mechanism. An end plate 24 having a charcoal filter 26 disposed within a circular hole 28 for filtering out impurities and contaminants from the atmosphere within the fixture while allowing for pressure balance between the interior of the housing formed by member 12 and cap 14 and the lamp enclosure is connected to the edge of the cylindrical member 20. A pair of generally cylindrical connecting rods 30, 32 extend through respective sleeves 29 in the end wall 24 and are connected by screws 31 at one end of each one of the pins to a U-shaped bracket member 34 having a standard threaded lamp socket 36 connected thereto, for example by screws 78, 80 for engagement with a high intensity lamp 38. A pair of electrical leads 40, 42 are connected to the end of the lamp socket 36 for connection to a source of electrical power for operating the lamp 38, for example by passing through grommets in the member 20 and end cap 14. FIG. 1*b* shows an enlargement of the elements within circle 49. A circular passage 44 is provided in the end wall 46 of the cap 14 to allow passage therethrough of a threaded bolt 48 having a thumb wheel 50 having a shoulder 51 for engagement with end surface 54 of end plate 46 attached to one end thereof. An o-ring 52 of flexible material such as rubber is placed around shoulder 51 between the top surface 54 of the plate 46 and the thumb wheel 50 to seal the opening 44. A collar 56 is attached to the bolt 48 by a fastening screw 58 to position the shoulder 51 of thumb wheel 50 to be in engagement with the surface 54 of the end wall 46 to stabilize the lamp support structure within the housing. A pair of bars 60 and 62 are fastened by screws 31 to the ends of the pins 30 and 32 as shown and are threaded at the center to be in threaded engagement with the bolt 48, so that as the bolt is turned the position of the bars 60 and 62 moves relative to the bolt 48 and housing members 12 and 14 causing the socket 36 to be moved axially. A set screw 64 is provided in the thumb wheel 50 so that any particular position of the thumb wheel can be set by simply screwing the end of the set screw 64 into engagement with the surface 54 of the end wall 46. A reflector housing 66 of for example die-cast aluminum and the reflector 68 of for example aluminum having a polished Alglas® finish are fastened to the end wall 22 by a convenient mechanism, for example the screws 70 and 72 as shown. A gasket member 74 of for example silicone separates the housing 66 from the reflector 68. The reflector 68, housing 66 and insulator 74 each have a circular passage therethrough to form a chamber around bracket 34, socket 36 and lamp 38 and allow the axial movement of the socket 36 and lamp 38 relative to the reflector 68.

Figure 4:
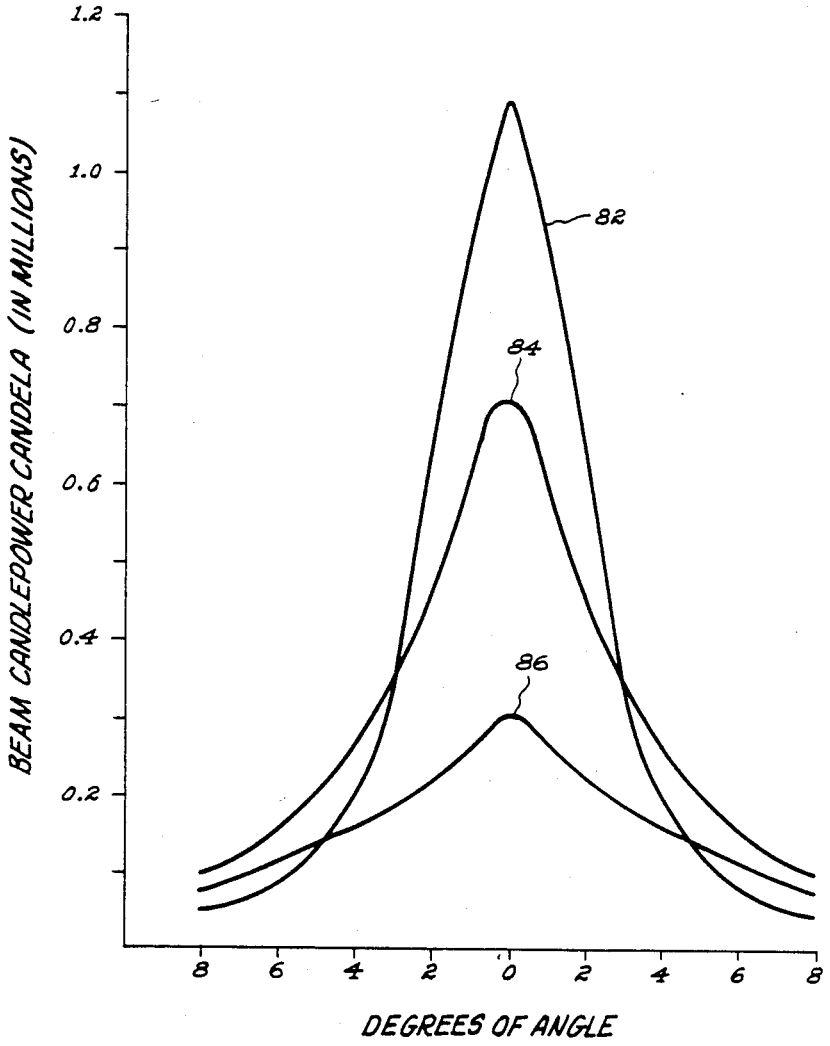
* and FIG. 4 is a graph illustrating the relative light output from the fixture relative to the angle of the viewer with respect to the axis of the lamp for several adjustments of the lamp relative to the reflector for a specific lamp made according to the present invention.

After installation of a lamp 38, typically a 175–1500 watt high intensity metal halide discharge lamp, into the socket 36 the installer can adjust the focus of the light beam produced by the fixture by releasing the screw 64 so that the thumb wheel 50 can be rotated to adjust the position of the bars 60 and 62 and thereby the complete support mechanism of lamp 38 to adjust the position of lamp 38 relative to the position at which the light output of lamp 38 is centered at the focal point of the reflector 68 thereby controlling the beam spread for the light output. In a particular embodiment of the present invention tested by the applicants a 250 watt metal halide lamp of the type described in U.S. patent application Ser. No. 825,727 filed Feb. 4, 1986 by French et al and assigned to the present assignee was installed in a fixture as described hereinabove. The fixture was designed to allow movement of the lamp from the focus of the reflector one and one-eighth inches backward, i.e. toward end wall 46, and three-eights inch forward for a maximum travel allowed by the bolt of about 1.5 inches in the axial direction. As will be understood the maximum travel in either direction can be changed by selection of the dimensions of fixture components for specific lamps. Measurements of the intensity of light relative to the angle from the axis 76 of the lamp socket 36 and lamp 38 produce the focus patterns shown by curves 82, 84 and 86 of FIG. 4. With the lamp positioned at the reflector focal point for a narrow focus the illumination pattern was as shown at 82 in FIG. 4 having a maximum illumination of approximately 1.10 million candle power along the axis of the reflector and declining to approximately ½ that level of illumination at approximately 2.2 degrees from the center line of the reflector. Positioning the lamp at a position at which the lamp is positioned about 0.5 inch backward (toward end wall 46) from the focused position produced the beam spread pattern shown at 84 of FIG. 4 in which maximum intensity at the centerline was about 0.71 million candlepower and fell to about ½ that level at about 3.2 degrees from the reflector centerline. With the lamp positioned in a location about 0.75 inch backward from the focused position to create a beam spread to cover a large expanse as shown at 86, the maximum illumination at the center line of the reflector was approximately 0.32 million candlepower and declined to a level of approximately ½ that intensity at an angle of 5.9 degrees relative to the center line of the reflector. Movement of the lamp and lamp socket forward relative to the focal point of the reflector produces approximately the same beam spreading effect as movement backward by the same distance.

Therefore it will be clear to those skilled in the art that the adjustable mount of the present invention enables positioning of a high intensity lamp at a variety of positions selected to control the beam spread from a narrow beam focus for highlighting specific areas to a broad beam spread for general surface illumination so that a single type of fixture can be used for illumination of a variety of surfaces.

What we claim as new and desire to secure by Letters Patent of the United States is:

1. A high intensity lamp mounting fixture comprising:

an annular housing member and an end cap member connected thereto forming a support housing means for enclosing an adjustable lamp socket holder means;

lamp reflector housing means connected to said support housing means;

parabolic reflector means disposed within said lamp reflector housing means for directing light output from a high intensity lamp mounted within said fixture;

lamp socket means for supporting and making electrical connection to a high intensity discharge lamp; and adjustable socket holder means disposed within said support housing means and connected to said support housing means for supporting said lamp socket means in adjustable position within said fixture, said adjustable socket holder means comprising:

a bracket means connected to said lamp socket means for supporting said lamp socket means;

connecting rod means connected at one end of said rod means to said bracket means for supporting said bracket means;

first and second bar means connected to said connecting rod means at the opposite end of said connecting means; and threaded adjustment screw means in adjustable threaded engagement with said bar means for adjusting the position of said bar means axially along said screw means; said screw means passing through a hole in one wall of said support housing means and being secured thereto in a predetermined axial position relative to said support housing means; whereby the position of said lamp socket means relative to said reflector means is controllable by rotation of said screw means.

2. The invention of claim 1 further comprising:

a thumb wheel head on the end of said adjustment screw means exterior to said support housing means; and set screw means in threaded engagement with said head of said adjustment screw means for engaging said outer surface of said one wall for fixing the rotational position of said adjustment screw means relative to said one wall.

3. The invention of claim 2 wherein:

said connecting rod means comprises a pair of connecting rods passing through a wall of said support housing means opposite said one wall and each of said pair of connecting rods being connected at one end thereof to said bracket means for supporting said bracket means and said socket means within said reflector housing means.

4. The invention of claim 3 wherein:

the total maximum length of adjustment distance for said lamp socket means is approximately 1.5 inches.

5. The invention of claim 3 wherein:

said bar means are positioned axially along said screw means such that said lamp socket is movable in either axial direction from a position which centers the light output of a high intensity discharge lamp disposed within said socket at the focal point of said parabolic reflector means.

6. The invention of claim 5 wherein:

the total maximum length of the adjustment distance for said lamp socket means is approximately 1.5 inches.

7. The invention of claim 2 wherein:

said adjustment screw means further comprises a shoulder member attached to the head of said adjustment screw means for engaging said outer surface of said one wall; and further comprising collar means fastened to the threaded shaft of said adjustment screw means and disposed in the inside of said one wall to secure said adjustment screw means axially relative to said one wall such that said collar means is in engagement with said outer surface of said one wall.

8. The invention of claim 7 further comprising:

a flexible o-ring disposed circumferentially around said collar means to seal said hole in said one wall when said collar means is held in engagement with said outer surface.

* * * * *